US011222564B2

(12) United States Patent
Yu et al.

(10) Patent No.: US 11,222,564 B2
(45) Date of Patent: Jan. 11, 2022

(54) DISPLAY PANEL, CONTROL METHOD AND CONTROL DEVICE THEREOF

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Yong Yu, Beijing (CN); Chang Zhang, Beijing (CN)

(73) Assignees: BOE TECHNOLOGY GROUP CO., LTD.; CHENGDU BOE OPTOELECTRONICS TECHNOLOGY CO., LTD.

( * ) Notice: Subject to any disclaimer, the term of this patent is extended or adjusted under 35 U.S.C. 154(b) by 0 days.

(21) Appl. No.: 16/756,508

(22) PCT Filed: Mar. 28, 2019

(86) PCT No.: PCT/CN2019/080029
§ 371 (c)(1),
(2) Date: Apr. 16, 2020

(87) PCT Pub. No.: WO2020/191698
PCT Pub. Date: Oct. 1, 2020

(65) Prior Publication Data

US 2021/0225225 A1 Jul. 22, 2021

(51) Int. Cl.
*G09G 3/00* (2006.01)

(52) U.S. Cl.
CPC ..... *G09G 3/035* (2020.08); *G09G 2320/0271* (2013.01); *G09G 2320/0626* (2013.01); *G09G 2320/0666* (2013.01); *G09G 2380/02* (2013.01)

(58) Field of Classification Search
None
See application file for complete search history.

(56) References Cited

U.S. PATENT DOCUMENTS

2008/0284794 A1* 11/2008 Wang ..... G09G 3/3688 345/618
2017/0169758 A1 6/2017 Park
(Continued)

FOREIGN PATENT DOCUMENTS

CN 103730090 A 4/2014
CN 105280139 A 1/2016
(Continued)

*Primary Examiner* — Aneeta Yodichkas
(74) *Attorney, Agent, or Firm* — The Webb Law Firm

(57) ABSTRACT

The present disclosure provides a display panel, a control method, and a control device thereof. The display panel includes a bending area. The bending area includes a plurality of sub-pixels. The control method includes: obtaining an attenuation parameter of a sub-pixel of at least one color in the bending area, wherein the attenuation parameter is a pre-attenuation amount of brightness attenuation of the sub-pixel; obtaining a pre-register value of the sub-pixel of the at least one color corresponding to grayscale data of a pixel to which the sub-pixel of the at least one color belongs; and adjusting light emission brightness of the sub-pixel of the at least one color based on the pre-register value and the attenuation parameter of the sub-pixel of the at least one color.

13 Claims, 7 Drawing Sheets

(56) References Cited

U.S. PATENT DOCUMENTS

| | | | | |
|---|---|---|---|---|
| 2018/0336824 | A1 | 11/2018 | Yang et al. | |
| 2018/0348569 | A1 | 12/2018 | Chen | |
| 2019/0005879 | A1* | 1/2019 | Shin | G09G 3/003 |
| 2019/0051230 | A1 | 2/2019 | Jeon et al. | |
| 2019/0074474 | A1* | 3/2019 | Du | G02F 1/133305 |

FOREIGN PATENT DOCUMENTS

| | | | |
|---|---|---|---|
| CN | 107068055 | A | 8/2017 |
| CN | 107274792 | A | 10/2017 |
| CN | 207320172 | U | 5/2018 |
| CN | 109300434 | A | 2/2019 |
| CN | 109300435 | A | 2/2019 |

* cited by examiner

DISPLAY PANEL, CONTROL METHOD AND CONTROL DEVICE THEREOF

CROSS-REFERENCE TO RELATED APPLICATION

This application is the United States national phase of International Application No. PCT/CN2019/080029 filed Mar. 28, 2019, the disclosure of which is hereby incorporated by reference in its entirety.

TECHNICAL FIELD

The present disclosure relates to a display panel, a control method, and a control device thereof.

BACKGROUND

Compared with a traditional liquid crystal display panel, an AMOLED (Active Matrix Organic Light Emitting Diode) display has the characteristics of faster response speed, higher contrast, wider viewing angle and lower power consumption. The AMOLED display may also be used in a bendable design. This characteristic may cause the AMOLED display to be used for a full-screen design or a folding mobile phone design.

SUMMARY

According to one aspect of embodiments of the present disclosure, a control method for a display panel is provided. The display panel comprises a bending area. The bending area comprises a plurality of sub-pixels. The control method comprises: obtaining an attenuation parameter of a sub-pixel of at least one color in the bending area, wherein the attenuation parameter is a pre-attenuation amount of brightness attenuation of the sub-pixel; obtaining a pre-register value of the sub-pixel of the at least one color corresponding to grayscale data of a pixel to which the sub-pixel of the at least one color belongs; and adjusting light emission brightness of the sub-pixel of the at least one color based on the pre-register value and the attenuation parameter of the sub-pixel of the at least one color.

In some embodiments, the obtaining of the attenuation parameter of the sub-pixel of the at least one color in the bending area comprises: determining a pixel column at a maximum curvature in the bending area, each pixel comprising a red sub-pixel, a green sub-pixel, and a blue sub-pixel; and obtaining the attenuation parameter of the sub-pixel of the at least one color of the each pixel in part of pixels in the bending area, wherein the part of pixels comprise pixels from a pixel column at a first edge of the bending area to the pixel column at the maximum curvature in the bending area, the display panel further comprises a non-bending area, and the first edge is at a boundary between the bending area and the non-bending area.

In some embodiments, the adjusting of the light emission brightness of the sub-pixel of the at least one color based on the pre-register value and the attenuation parameter of the sub-pixel of the at least one color comprises: determining an actual register value of the sub-pixel of the at least one color based on the pre-register value of the sub-pixel of the at least one color and the attenuation parameter of the sub-pixel of the at least one color; and controlling the light emission brightness of the sub-pixel of the at least one color based on the actual register value of the sub-pixel of the at least one color.

In some embodiments, the actual register value of the sub-pixel is a difference between the pre-register value of the sub-pixel and the attenuation parameter of the sub-pixel.

In some embodiments, the attenuation parameter m of the sub-pixel of the at least one color is obtained according to the following relation: $m=ax+b$, where "x" represents a position of a sub-pixel of a certain color of which the attenuation parameter needs to be calculated, wherein the position "x" is a number of sub-pixels of the certain color between the sub-pixel of the certain color and the first edge of the bending area, and in a sub-pixel row where the sub-pixel of the certain color is located, in a case where the sub-pixel of the certain color is between the first edge and the pixel column at the maximum curvature, "a" is a first parameter for calculating the attenuation parameter of the sub-pixel of the certain color, and "b" is a second parameter for calculating the attenuation parameter of the sub-pixel of the certain color.

In some embodiments, the control method further comprises: obtaining the first parameter and the second parameter for the sub-pixel of the at least one color of the display panel before the attenuation parameter of the sub-pixel of the at least one color in the bending area is obtain.

In some embodiments, the obtaining of the first parameter and the second parameter for the sub-pixel of the at least one color of the display panel comprises: selecting the first parameter "a" to be determined for the sub-pixel of the certain color from a predetermined range of the first parameter for the sub-pixel of the at least one color, and selecting the second parameter "b" to be determined for the sub-pixel of the certain color from a predetermined range of the second parameter for the sub-pixel of the at least one color; obtaining the relation $m=ax+b$ of the sub-pixel of the certain color to be determined based on the first parameter to be determined and the second parameter to be determined, thereby obtaining the attenuation parameter of the sub-pixel of the certain color in the bending area; adjusting the light emission brightness of the sub-pixel of the certain color based on the attenuation parameter of the sub-pixel of the certain color; causing the display panel to display an image after the light emission brightness of the sub-pixel of the certain color is adjusted; and comparing color coordinates of the image displayed in the non-bending area of the display panel with color coordinates of the image displayed in the bending area, and determining whether the first parameter to be determined is able to serve as the first parameter for the sub-pixel of the certain color of the display panel, and whether the second parameter to be determined is able to serve as the second parameter for the sub-pixel of the certain color of the display panel based on a comparison result.

In some embodiments, the comparing comprises: obtaining the color coordinates of the image displayed in the non-bending area and the color coordinates of the image displayed in the bending area at a viewing angle perpendicular to the non-bending area; and calculating a difference between the color coordinates of the image displayed in the non-bending area and the color coordinates of the image displayed in the bending area; the determining based on the comparison result comprises: determining whether the difference is within a predetermined error range; determining the first parameter to be determined as the first parameter for the sub-pixel of the certain color of the display panel, and the second parameter to be determined as the second parameter for the sub-pixel of the certain color of the display panel, in a case where the difference is within the predetermined error range; and reselecting the first parameter to be determined and the second parameter to be determined in a case where the difference is not within the predetermined error range.

In some embodiments, the predetermined range of the first parameter "a" is $0<a\leq 5$; and the predetermined range of the second parameter "b" is $0\leq b\leq 100$.

In some embodiments, the attenuation parameter of the sub-pixel of the at least one color comprises an attenuation parameter of the red sub-pixel; and the attenuation parameter $m_R$ of the red sub-pixel is obtained according to the following relation: $m_R=a_Rx_R+b_R$, where $x_R$ represents a position of the red sub-pixel of which the attenuation parameter needs to be calculated, wherein the position $x_R$ is a number of red sub-pixels between the red sub-pixel and the first edge of the bending area, and in a sub-pixel row where the red sub-pixel is located, in a case where the red sub-pixel is between the first edge and the pixel column at the maximum curvature, $a_R$ is a first parameter for calculating the attenuation parameter of the red sub-pixel, and $b_R$ is a second parameter for calculating the attenuation parameter of the red sub-pixel.

In some embodiments, the attenuation parameter of the sub-pixel of the at least one color comprises an attenuation parameter of the green sub-pixel; and the attenuation parameter $m_G$ of the green sub-pixel is obtained according to the following relation: $m_G=a_Gx_G+b_G$, where $x_G$ represents a position of the green sub-pixel of which the attenuation parameter needs to be calculated, wherein the position $x_G$ is a number of green sub-pixels between the green sub-pixel and the first edge of the bending area, and in a sub-pixel row where the green sub-pixel is located, in a case where the green sub-pixel is between the first edge and the pixel column at the maximum curvature, $a_G$ is a first parameter for calculating the attenuation parameter of the green sub-pixel, and $b_G$ is a second parameter for calculating the attenuation parameter of the green sub-pixel.

In some embodiments, the attenuation parameter of the sub-pixel of the at least one color comprises an attenuation parameter of the blue sub-pixel; the attenuation parameter $m_B$ of the blue sub-pixel is obtained according to the following relation: $m_B=a_Bx_B+b_B$, where $x_B$ represents a position of the blue sub-pixel of which the attenuation parameter needs to be calculated, wherein the position $x_B$ is a number of blue sub-pixels between the blue sub-pixel and the first edge of the bending area, and in a sub-pixel row where the blue sub-pixel is located, in a case where the blue sub-pixel is between the first edge and the pixel column at the maximum curvature, $a_B$ is a first parameter for calculating the attenuation parameter of the blue sub-pixel, and $b_B$ is a second parameter for calculating the attenuation parameter of the blue sub-pixel.

In some embodiments, in the bending area, sub-pixels in a same sub-pixel column have a same light emission color, and sub-pixels in two adjacent sub-pixel columns have different light emission colors, and the green sub-pixel is between the red sub-pixel and the blue sub-pixel in the each pixel.

According to another aspect of embodiments of the present disclosure, a display panel is provided. The display panel comprises: the bending area comprising a plurality of pixels, each of which comprises a red sub-pixel, a green sub-pixel, and a blue sub-pixel; wherein in the bending area, sub-pixels in a same sub-pixel column have a same light emission color, sub-pixels in two adjacent sub-pixel columns have different light emission colors, and the green pixel is between the red sub-pixel and the blue sub-pixel in each of the plurality of pixels.

According to another aspect of embodiments of the present disclosure, a control device for a display panel is provided. The display panel comprises a bending area. The bending area comprises a plurality of sub-pixels. The control device comprising: an obtaining sub-circuit configured to obtain an attenuation parameter of a sub-pixel of at least one color in the bending area, wherein the attenuation parameter is a pre-attenuation amount of brightness attenuation of the sub-pixel; and an adjusting sub-circuit configured to obtain a pre-register value of the sub-pixel of the at least one color corresponding to gray-scale data of a pixel to which the sub-pixel of the at least one color belongs, and adjust light emission brightness of the sub-pixel of the at least one color based on the pre-register value and the attenuation parameter of the sub-pixel of the at least one color.

According to another aspect of the embodiments of the present disclosure, a control device for a display panel is provided. The control device for a display panel comprises: a memory; and a processor coupled to the memory, wherein the processor is configured to execute the control method as described above based on instructions stored in the memory.

According to another aspect of embodiments of the present disclosure, a display device is provided. The display device comprises the control device as described above.

According to another aspect of embodiments of the present disclosure, a non-transitory computer-readable storage medium having computer program instructions stored thereon is provided. The instructions when executed by a processor implement steps of the control method as described above.

Other features and advantages of the present disclosure will become apparent from the following detailed description of exemplary embodiments of the present disclosure in conjunction with the accompanying drawings.

BRIEF DESCRIPTION OF THE DRAWINGS

The accompanying drawings, which constitute part of this specification, illustrate exemplary embodiments of the present disclosure and, together with this specification, serve to explain the principles of the present disclosure.

The present disclosure may be more clearly understood from the following detailed description in conjunction with the accompanying drawings, in which.

Figure 1A:
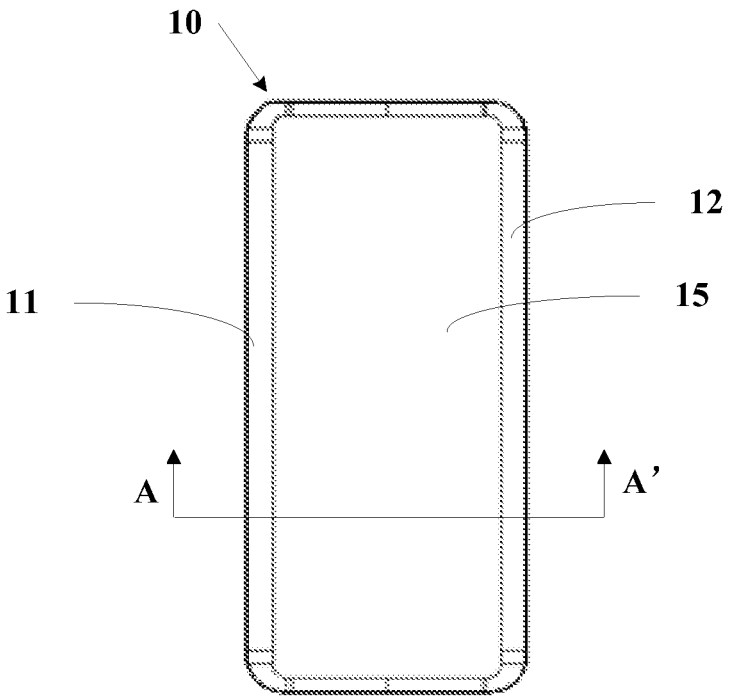
FIG. 1A is a front view showing a cover plate of a display device according to an embodiment of the present disclosure.

It should be understood that the dimensions of the various parts shown in the accompanying drawings are not necessarily drawn according to the actual scale. In addition, the same or similar reference signs are used to denote the same or similar components.

DETAILED DESCRIPTION

Various exemplary embodiments of the present disclosure will now be described in detail in conjunction with the accompanying drawings. The description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "include", or the like means that the element before the word covers the element(s) listed after the word without excluding the possibility of also covering other elements. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is connected to other devices, the particular device may be directly connected to said other devices without an intermediate device, and alternatively, may not be directly connected to said other devices but with an intermediate device.

All the terms (comprising technical and scientific terms) used in the present disclosure have the same meanings as understood by those skilled in the art of the present disclosure unless otherwise defined. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

Figure 1B:
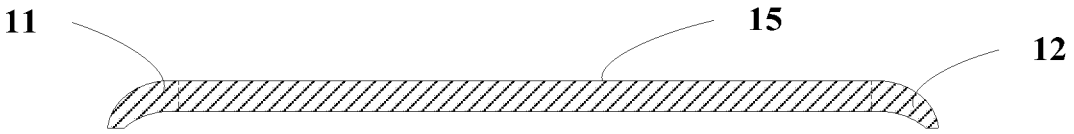
FIG. 1B is a cross-sectional view showing a structure of a cover plate of a display device taken along a line A-A' in FIG. 1A according to an embodiment of the present disclosure.

FIG. 1A is a front view showing a cover plate of a display device according to an embodiment of the present disclosure. FIG. 1B is a cross-sectional view showing a structure of a cover plate of a display device taken along a line A-A' in FIG. 1A according to an embodiment of the present disclosure. For example, the display device may be a mobile phone or the like. As shown in FIGS. 1A and 1B, the cover plate 10 may comprise bending areas 11 and 12 and a non-bending area 15.

The flexible display panel may be attached to the cover plate. For example, the cover plate has a bending area, and the flexible display panel may be completely attached to a side (which may be referred to as the inner side) of the cover plate toward a bending direction. Since an area of the contact surface between the flexible display panel and the cover plate is larger than that of the non-bending area of the cover plate, the flexible display panel may also bend under such bonding method. Therefore, the display panel may also comprise a bending area and a non-bending area. Those skilled in the art can appreciate that, for some display devices (e.g., a smart bracelet and the like), the display panel may also not comprise the non-bending area.

Figure 2A:
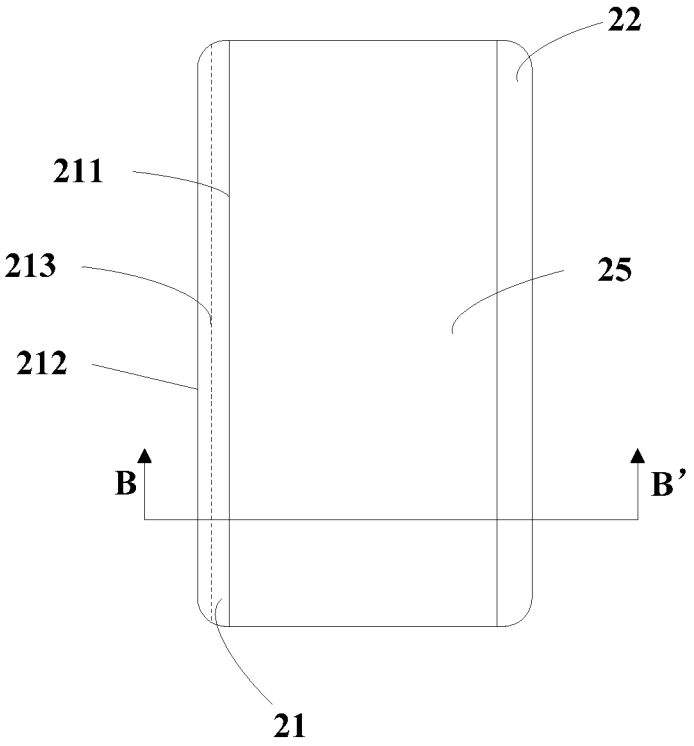
FIG. 2A is a front view showing a display panel according to an embodiment of the present disclosure.
Figure 2B:
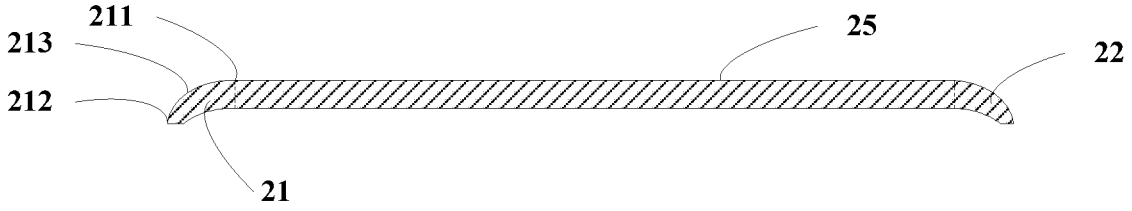
FIG. 2B is a schematic cross-sectional view showing a structure of a display panel taken along a line B-B' in FIG. 2A according to an embodiment of the present disclosure.

FIG. 2A is a front view showing a display panel according to an embodiment of the present disclosure. FIG. 2B is a schematic cross-sectional view showing a structure of a display panel taken along a line B-B' in FIG. 2A according to an embodiment of the present disclosure.

As shown in FIG. 2A and FIG. 2B, the display panel may comprise a bending area (e.g., bending areas 21 and 22) and a non-bending area (or referred to as a flat area) 25. The bending area may comprise a plurality of sub-pixels. The bending areas 21 and 22 are on both sides of the non-bending area 25 respectively. Taking the bending area 21 as an example, as shown in FIGS. 2A and 2B, the bending area 21 may comprise a first edge 211 and a second edge 212. The first edge 211 is parallel to the second edge 212. The first edge 211 is at a boundary between the bending area 21 and the non-bending area 25. In other words, the first edge 211 is at a position where the bending area starts to bend. The second edge 212 is an actual edge of the display panel. FIGS. 2A and 2B also show a position 213 at a maximum curvature in the bending area.

In some embodiments, the bending area may comprise a plurality of pixels. Each pixel comprises a red sub-pixel, a green sub-pixel, and a blue sub-pixel.

During the process of observing the displayed image, a viewing angle of the observer is a angle between an actual line of sight in observation and an front view direction. Here, the actual line of sight in observation is the direction of the line connecting the human eye to the observed sub-pixel; the observed sub-pixel serves as the tangent point to implement the tangent line of the display panel (e.g., the bending area), and the front view direction is a direction perpendicular to the tangent line (i.e., a normal direction of a display surface at this tangent point). The inventors of the present disclosure have found that since the front view direction of the bending area is gradual, the viewing angle of observing the bending area is gradual in a case where the actual line of sight in observation is always perpendicular to the display surface of the non-bending area. This results in that the micro-cavity effect inside the display panel also changes gradually. Here, the micro-cavity effect means that the light emitted by the sub-pixel may be regarded as propagating through reflection and/or refraction in the cavity when it propagates between the layers of the display panel. The light emitted by sub-pixels of different colors may be attenuated differently when propagating by reflection and/or refraction. Therefore, the attenuations of the red sub-pixel, the green sub-pixel, and the blue sub-pixel are inconsistent at the same viewing angle when the viewing angle is greater than 0 degree, in a case where the aperture ratios of all sub-pixels of the display panel are the same. This may result in the problem of color cast in the bending area and reduce the display effect. For example, the brightness of the red sub-pixel is less attenuated, and the brightness of the blue and green sub-pixels is more attenuated, which may cause the bending area to be reddish or pinkish, reducing the display effect.

In view of this, the embodiments of the present disclosure provide a control method for a display panel to adjust the attenuation condition of a sub-pixel and improve the display effect of the display panel.

Figure 3:
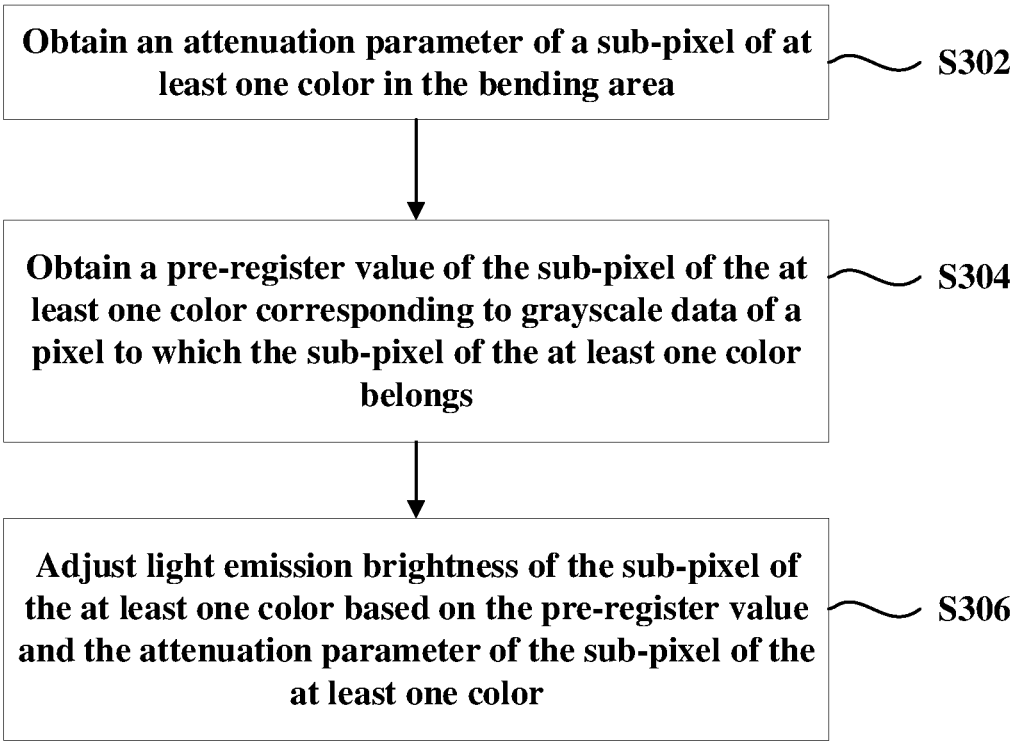
FIG. 3 is a flowchart showing a control method for a display panel according to an embodiment of the present disclosure.

FIG. 3 is a flowchart showing a control method for a display panel according to an embodiment of the present disclosure. As shown in FIG. 3, the control method may comprise steps S302 to S306.

At step S302, an attenuation parameter of a sub-pixel of at least one color in the bending area is obtained. The attenuation parameter is a pre-attenuation amount of brightness attenuation of a sub-pixel.

For example, the attenuation parameters of sub-pixels of different colors in the bending area may be obtained. The sub-pixels of different colors here may comprise a red sub-pixel, a green sub-pixel, and a blue sub-pixel. The sub-pixels of different colors may have different attenuation parameters. For another example, attenuation parameters of sub-pixels of one color or two colors may be obtained.

In some embodiments, the step S302 may comprise: determining a pixel column at a maximum curvature in the bending area. It should be noted that the pixel column described here refers to a column of pixels in the same direction as the extending direction of the first edge or the second edge. Each pixel comprises a red sub-pixel, a green sub-pixel, and a blue sub-pixel. Here, each pixel column may comprise a red sub-pixel column, a green sub-pixel column, and a blue sub-pixel column adjacent to each other. It should also be noted that the sub-pixel column described here refers to a column of sub-pixels in the same direction as the extending direction of the first edge or the second edge.

In some embodiments, the step S302 may further comprise: obtaining the attenuation parameter of the sub-pixel of the at least one color of each pixel in part of pixels in the bending area. The part of pixels comprise pixels from a pixel column at the first edge of the bending area to the pixel column at the maximum curvature in the bending area. The first edge is at the boundary between the bending area and the non-bending area. It should be noted that the "pixels from the pixel column at the first edge of the bending area to the pixel column at the maximum curvature" described herein may comprise: pixels in the pixel column at the first edge of the bending area and pixels in the pixel column at the maximum curvature.

In this embodiment, the sub-pixels of the pixel column at the maximum curvature may be determined after the pixel column at the maximum curvature is determined. In general, the sub-pixel at the first edge has a less attenuation parameter (e.g., it might be close to 0). Since the attenuation parameter of sub-pixels of the same color may be considered in a linear relationship (described in detail below) with the positions of the sub-pixels, a corresponding linear function relation may be obtained based on the attenuation parameter of the sub-pixel at the maximum curvature and the attenuation parameter of the sub-pixel at the first edge, wherein the two sub-pixels have the same color. In this way, the attenuation parameters of sub-pixels of the same color from the first edge to the pixel column at the maximum curvature in the bending area may be determined. Therefore, the brightness of the sub-pixels may be adjusted based on the attenuation parameters of sub-pixels of the same color. In addition, since the human eye usually does not pay attention to the light emission condition of the sub-pixels from the pixel column at the maximum curvature to the second edge, it results in that the light emission condition of these sub-pixels has less influence on the display effect of the display panel, so that the light emission condition of these sub-pixels may be omitted.

By performing curve fitting on a large amount of data, the inventors of the present disclosure have found that, from the first edge to the pixel column at the maximum curvature, there is a relatively high curve fit when the relationship curve between the attenuation parameters of sub-pixels of each color and the positions of the sub-pixels is fitted to a straight line (or line segment). Therefore, the relationship between the attenuation parameters of the sub-pixels of each color and the positions of the sub-pixels is close to a linear relationship. Here, the number of sub-pixels that are between a sub-pixel and the first edge of the bending area, have the same color as the sub-pixel, and located in the same sub-pixel row may be represented as the position of the sub-pixel. Here, the sub-pixel row refers to a row of sub-pixels in a direction perpendicular to a direction of the sub-pixel column. In other words, the sub-pixel row refers to a row of sub-pixels in a direction perpendicular to the extending direction of the first edge.

In some embodiments, the attenuation parameter m of the sub-pixel of the at least one color may be obtained according to the following relationship:

$$m=ax+b, \tag{1}$$

where "x" represents a position of a sub-pixel of a certain color, of which the attenuation parameter needs to be calculated. The position "x" is a number of sub-pixels of the certain color between the sub-pixel of the certain color and the first edge of the bending area, and in a sub-pixel row where the sub-pixel of the certain color is located, in a case where the sub-pixel of the certain color is between the first edge and the pixel column at the maximum curvature. In some embodiments, when the sub-pixels between the above-described sub-pixel and the first edge are counted, the sub-pixel at the first edge and the above-described sub-pixel itself may also be counted. That is, the counted sub-pixels may comprise the sub-pixel at the first edge and the above-described sub-pixel itself. Here, $0 \le x \le$ half the lateral resolution of the display panel, and x is a positive integer. For example, if the resolution of the display panel is 1440×2880, the range of x is [0, 720]. In addition, in the above-described relation (1), "a" is a first parameter for calculating the attenuation parameter of the sub-pixel of the certain color, and "b" is a second parameter for calculating the attenuation parameter of the sub-pixel of the certain color. Sub-pixels of different colors might have different first parameters, and sub-pixels of different colors might also have different second parameters.

In addition, it should be also noted that the above-described relation (1) calculates the attenuation parameter of each sub-pixel from the first edge to the pixel column at the maximum curvature. If necessary, the attenuation parameter of each sub-pixel from the pixel column at the maximum curvature to the second edge may also be calculated artificially according to the above-described relation. In this case, the position "x" is the number of sub-pixels between the sub-pixel of which the attenuation parameter needs to be calculated and the second edge, in a sub-pixel row where the sub-pixel is located, and having the same color as the sub-pixel.

In some embodiments, the attenuation parameter of the sub-pixel of the at least one color may comprise an attenuation parameter of the red sub-pixel. The attenuation parameter $m_R$ of the red sub-pixel may be obtained according to the following relation (which may be referred to as a first relation):

$$m_R=a_R x_R+b_R, \tag{2}$$

where $x_R$ represents a position of the red sub-pixel, of which the attenuation parameter needs to be calculated. The position $x_R$ is a number of red sub-pixels between the red sub-pixel and the first edge of the bending area, and in a sub-pixel row where the red sub-pixel is located, in a case where the red sub-pixel is between the first edge and the pixel column at the maximum curvature. In some embodiments, when the red sub-pixels between the above-described red sub-pixel and the first edge are counted, the red sub-pixel at the first edge and the above-described red sub-pixel itself may also be counted. That is, the counted red sub-pixels may comprise the red sub-pixel at the first edge and the above-described red sub-pixel itself. $a_R$ is a first parameter for calculating the attenuation parameter of the red sub-pixel, and $b_R$ is a second parameter for calculating the attenuation parameter of the red sub-pixel.

In other embodiments, the attenuation parameter of the sub-pixel of the at least one color may comprise an attenuation parameter of the green sub-pixel. The attenuation parameter $m_G$ of the green sub-pixel may be obtained according to the following relation (which may be referred to as a second relation):

$$m_G=a_G x_G+b_G, \tag{3}$$

where $x_G$ represents the position of the green sub-pixel, of which the attenuation parameter needs to be calculated. The position $x_G$ is a number of green sub-pixels between the green sub-pixel and the first edge of the bending area, and in a sub-pixel row where the green sub-pixel is located, in a case where the green sub-pixel is between the first edge and the pixel column at the maximum curvature. In some embodiments, when the green sub-pixels between the above-described green sub-pixel and the first edge are counted, a green sub-pixel at the first edge and the above-described green sub-pixel itself may also be counted. That is, the counted green sub-pixels may comprise the green sub-pixel at the first edge and the above-described green sub-pixel itself. $a_G$ is a first parameter for calculating the attenuation parameter of the green sub-pixel, and $b_G$ is a second parameter for calculating the attenuation parameter of the green sub-pixel.

In other embodiments, the attenuation parameter of the sub-pixel of the at least one color may comprise an attenuation parameter of the blue sub-pixel. The attenuation parameter $m_B$ of the blue sub-pixel may be obtained according to the following relation (which may be referred to as a third relation):

$$m_B=a_B x_B+b_B, \tag{4}$$

where $x_B$ represents a position of the blue sub-pixel, of which the attenuation parameter needs to be calculated. The position $x_B$ is a number of blue sub-pixels between the blue sub-pixel and the first edge of the bending area, and in a sub-pixel row where the blue sub-pixel is located, in a case where the blue sub-pixel is between the first edge and the pixel column at the maximum curvature. In some embodiments, when the blue sub-pixels between the above-described blue sub-pixel and the first edge are counted, the blue sub-pixel at the first edge and the above-described blue sub-pixel itself may also be counted. That is, the counted blue sub-pixels may comprise the blue sub-pixel at the first edge and the above-described blue sub-pixel itself. $a_B$ is a first parameter for calculating the attenuation parameter of the blue sub-pixel, and $b_B$ is a second parameter for calculating the attenuation parameter of the blue sub-pixel.

At step S304, a pre-register value of the sub-pixel of the at least one color corresponding to grayscale data of a pixel to which the sub-pixel of the at least one color belongs is obtained.

For example, the grayscale data of each pixel corresponds to the pre-register values of the red, green, and blue sub-pixels belonging to the each pixel. For example, the pre-register value may be a hexadecimal value. Here, each of the red, green, and blue sub-pixels of a pixel has a pre-register value. In a pixel, of sub-pixels of different colors might have different pre-register values. Therefore, the respective pre-register values of sub-pixels of different colors of a pixel may be obtained according to the gray-scale data of the pixel. For example, the grayscale data may comprise high-order data (e.g., high-order eight-bit data) and low-order data (e.g., low-order eight-bit data).

At step S306, light emission brightness of the sub-pixel of the at least one color is adjusted based on the pre-register value and the attenuation parameter of the sub-pixel of the at least one color.

In some embodiments, the step S306 may comprise: determining an actual register value of the sub-pixel of the at least one color based on the pre-register value of the sub-pixel of the at least one color and the attenuation parameter of the sub-pixel of the at least one color. The actual register value is an adjusted register value. For example, the actual register value of the sub-pixel=the pre-register value of the sub-pixel−the attenuation parameter of the sub-pixel. That is, the actual register value of the sub-pixel is a difference between the pre-register value of the sub-pixel and the attenuation parameter of the sub-pixel. The actual register values of sub-pixels of the different colors may be obtained by respectively subtracting a corresponding appropriate attenuation parameter from the pre-register values of these sub-pixels. Since the brightness attenuation degree of a sub-pixel may be presented as a sum of a brightness attenuation degree reflected by the attenuation parameter and a actual brightness attenuation degree when the sub-pixel emits light, when these sub-pixels emit light using the respective actual register values, the brightness attenuation degree of sub-pixels of different colors at the same viewing angle tends to be consistent, so that the problem of color cast in the bending area may be reduced.

For example, an actual register value of the red sub-pixel is determined based on the pre-register value of the red sub-pixel and the attenuation parameter of the red sub-pixel. The actual register value of the red sub-pixel=the pre-register value of the red sub-pixel−the attenuation parameter of the red sub-pixel.

For another example, an actual register value of the green sub-pixel is determined based on the pre-register value of the green sub-pixel and the attenuation parameter of the green sub-pixel. The actual register value of the green sub-pixel=the pre-register value of the green sub-pixel−the attenuation parameter of the green sub-pixel.

For another example, an actual register value of the blue sub-pixel is determined based on the pre-register value of the blue sub-pixel and the attenuation parameter of the blue sub-pixel. The actual register value of the blue sub-pixel=the pre-register value of the blue sub-pixel−the attenuation parameter of the blue sub-pixel.

In some embodiments, the step S306 may further comprise: controlling the light emission brightness of the sub-pixel of the at least one color based on the actual register value of the sub-pixel of the at least one color. For example, the light emission brightness of the red sub pixel is controlled based on the actual register value of the red sub pixel, the light emission brightness of the green sub pixel is controlled based on the actual register value of the green sub pixel, and the light emission brightness of the blue sub pixel is controlled based on the actual register value of the blue sub pixel. Each actual register value may be converted into a data voltage for a corresponding sub-pixel, thereby controlling the light emission brightness of the corresponding sub-pixel.

So far, a control method for a display panel according to some embodiments of the present disclosure is provided. The control method may comprise: obtaining an attenuation parameter of the sub-pixel of the at least one color in the bending area; obtaining a pre-register value of the sub-pixel of the at least one color corresponding to gray-scale data of a pixel to which the sub-pixel of the at least one color belongs; and adjusting the light emission brightness of the sub-pixel of the at least one color based on the pre-register value and the attenuation parameter of the sub-pixel of the at least one color. In this embodiment, by adjusting the light emission brightness of the sub-pixel of a corresponding color based on the attenuation parameter, it is possible to cause sub-pixels of different colors in the bending area to have substantially the same attenuation condition, which may reduce the problem of color cast (e.g., basically not reddish or pinkish any longer), and improve the display effect of the display panel.

Figure 4:
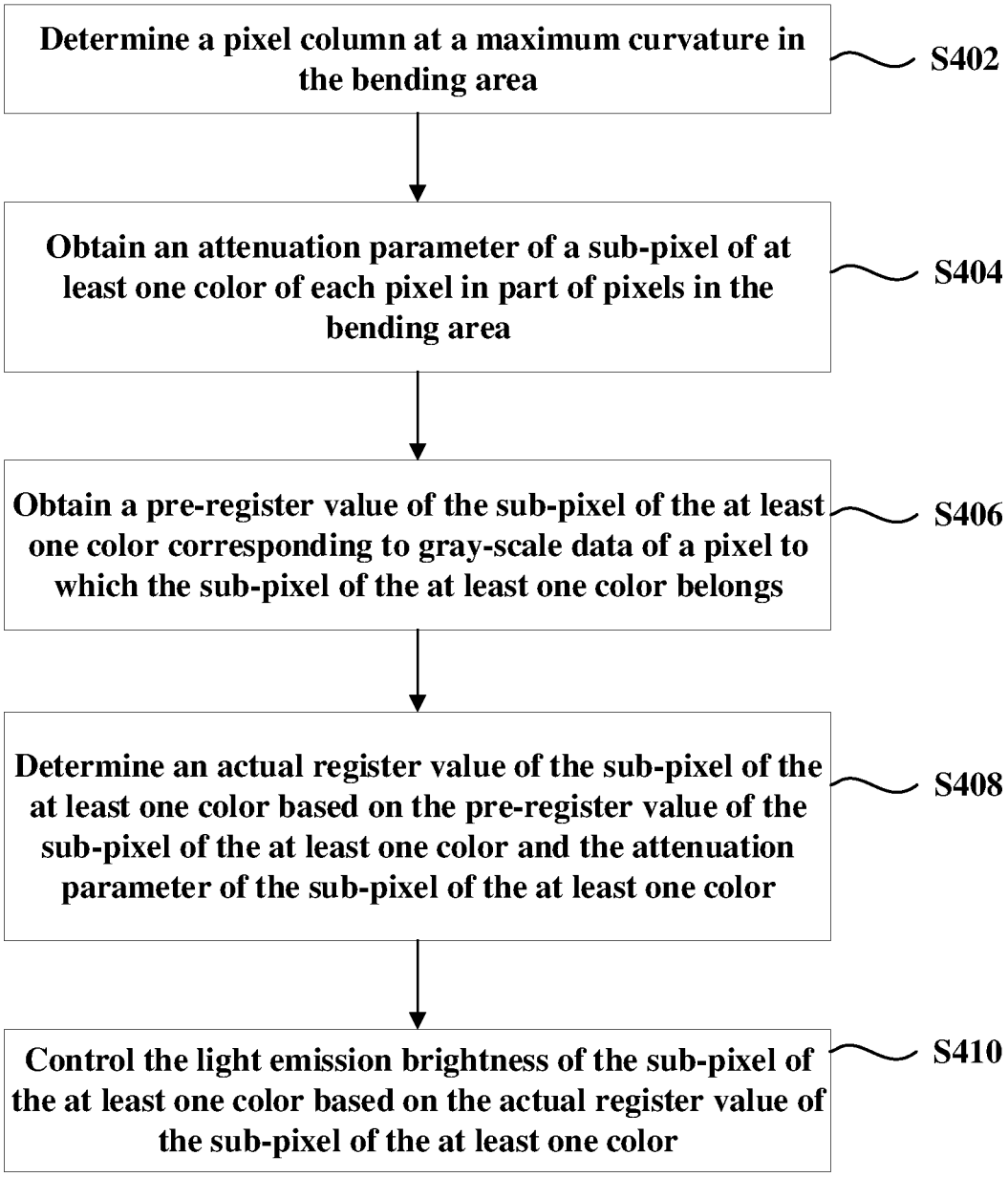
FIG. 4 is a flowchart showing a control method for a display panel according to another embodiment of the present disclosure.

FIG. 4 is a flowchart showing a control method for a display panel according to another embodiment of the present disclosure. As shown in FIG. 4, the control method may comprise steps S402 to S410.

At step S402, a pixel column at a maximum curvature in the bending area is determined.

At step S404, an attenuation parameter of the sub-pixel of the at least one color of each pixel in part of pixels in the bending area is obtained. The part of pixels comprise pixels from a pixel column at the first edge of the bending area to the pixel column at the maximum curvature. The first edge is at the boundary between the bending area and the non-bending area.

At step S406, a pre-register value of the sub-pixel of the at least one color corresponding to gray-scale data of a pixel to which the sub-pixel of the at least one color belongs is obtained.

At step S408, an actual register value of the sub-pixel of the at least one color is determined based on the pre-register value of the sub-pixel of the at least one color and the attenuation parameter of the sub-pixel of the at least one color.

At step S410, the light emission brightness of the sub-pixel of the at least one color is controlled based on the actual register value of the sub-pixel of the at least one color.

In this embodiment, a control method for a display panel according to other embodiments of the present disclosure is provided. In the above-described method, an attenuation parameter of the sub-pixel of the at least one color is obtained after the pixel column at the maximum curvature is determined, so that the control method may simplify the process of obtaining the attenuation parameter of the sub-pixel. In addition, by adjusting the light emission brightness of the corresponding color of sub-pixels based on the attenuation parameter, it is possible to cause sub-pixels of different colors in the bending area to have substantially the same attenuation condition, which may reduce the problem of color cast in the bending area (e.g., basically not reddish or pinkish any longer), and improve the display effect of the display panel.

For example, since the design of the cover plate has been determined before the display panel is attached to the cover plate, the physical relative position of the bending area may be determined. After the bending area is determined, the pixel column at the maximum curvature has been determined. Since a material of a light emitting layer and the transmittance and curvature of the glass cover plate (CG) are determined, the light emission brightness of the sub-pixel of each color may be adjusted by adjusting a register value of the sub-pixel, so that the display of the bending area is normal, and the problem of color cast is reduced.

In some embodiments, the control method may further comprise: obtaining the first parameter and the second parameter for the sub-pixel of the at least one color of the display panel before obtaining the attenuation parameter of the sub-pixel of the at least one color in the bending area.

It should be noted that, in the above-described embodiment of the present disclosure, the brightness of the sub-pixels in the bending area on the left side (or right side) of the non-bending area is adjusted by using the above-described control method. However, the scope of the embodiments of the present disclosure is not limited thereto. For example, the above-described control method may also be used to adjust the light emission brightness of the sub-pixels in the bending area in a case where the upper and lower sides of the non-bending area respectively have bending areas. In such case, the attenuation parameter of each sub-pixel between the first edge and the pixel column at a maximum curvature may also be calculated using the above-described relation (1). The first edge is at a boundary of the non-bending area and the bending area. It should be noted that the first edge is parallel to a sub-pixel row. At this time, in the relation (1), the position x is the number of sub-pixels between a sub-pixel of which the attenuation parameter needs to be calculated and the first edge, in a sub-pixel column where the sub-pixel is located, and having the same color as the sub-pixel.

Figure 5:
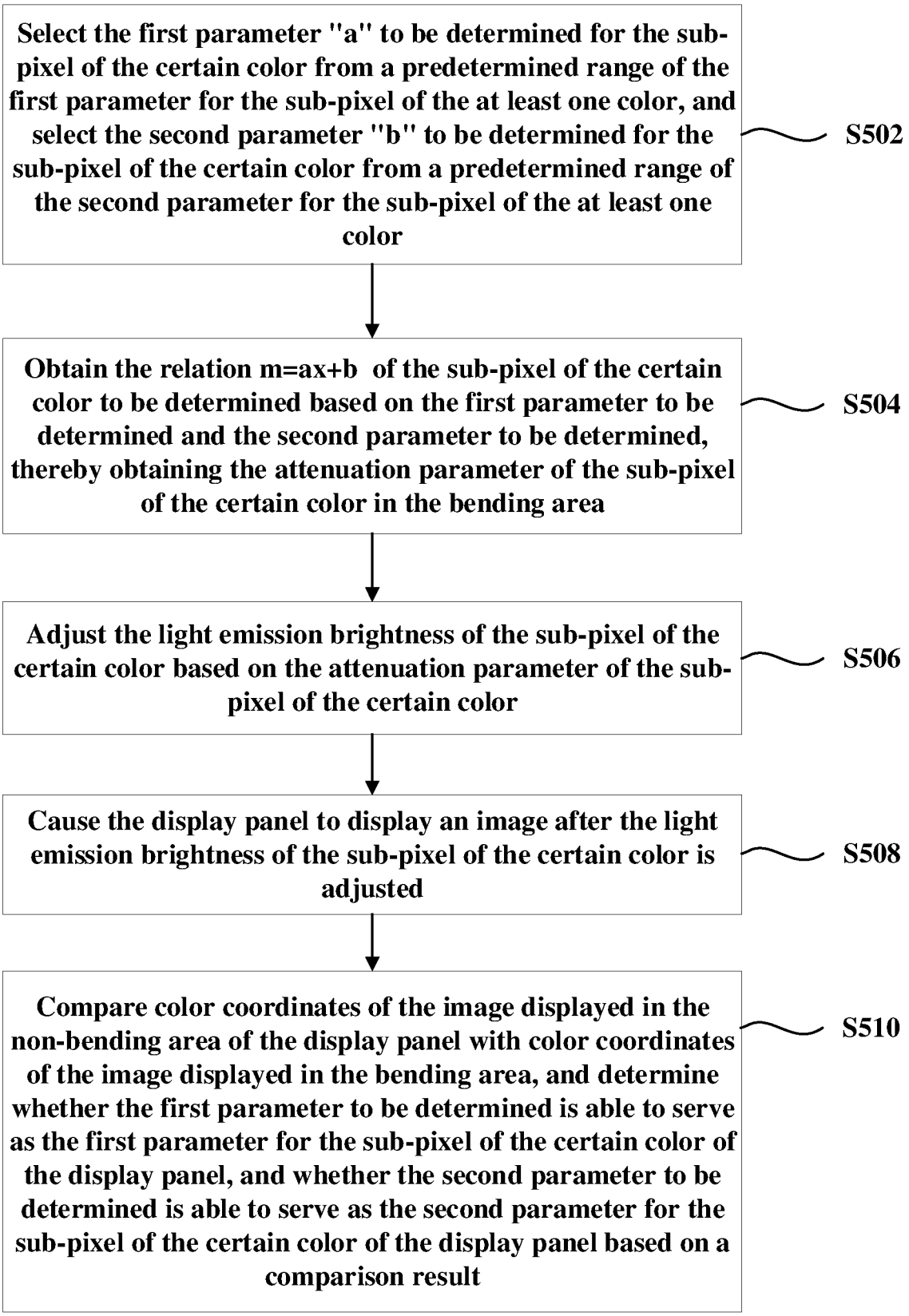
FIG. 5 is a flowchart showing a method for obtaining a first parameter and a second parameter according to an embodiment of the present disclosure.

The process of obtaining the first parameter and the second parameter will be described in detail below in conjunction with FIG. 5. FIG. 5 is a flowchart showing a method of obtaining a first parameter and a second parameter according to an embodiment of the present disclosure. As shown in FIG. 5, the method may comprise steps S502 to S510. Here, the display panel used in the method comprises the bending area and the non-bending area.

At step S502, a first parameter "a" to be determined for a sub-pixel of a certain color is selected from a predetermined range of the first parameter for the sub-pixel of at least one color, and a second parameter "b" to be determined for the sub-pixel of the certain color is selected from a predetermined range of the second parameter for the sub-pixel of the at least one color.

In some embodiments, the predetermined range of the first parameter "a" is $0<a\leq5$; the predetermined range of the second parameter "b" is $0 \leq a \leq 100$. For example, the predetermined ranges of the first parameters for sub-pixels of different colors may be the same; the predetermined ranges of the second parameters for the sub-pixels of different colors may be the same. That is, the predetermined ranges of the first parameters "a" for the sub-pixels of different colors may all be $0 < a \leq 5$; the predetermined ranges of the second parameters "b" for the sub-pixels of different colors may all be $0 \leq b \leq 100$. For another example, the predetermined ranges of the first parameters for the sub-pixels of different colors may be different; the predetermined ranges of the second parameters for the sub-pixels of different colors may be different.

In some embodiments, for sub-pixels of different colors, different first parameters may be selected from the predetermined range of the first parameter, and different second parameters may be selected from the predetermined range of the second parameter.

For example, the first parameter $a_R$ to be determined for the red sub-pixel may be selected from a predetermined range of the first parameter for the red sub-pixel, and the second parameter $b_R$ to be determined for the red sub-pixel may be selected from a predetermined range of the second parameter for the red sub-pixel. The first parameter $a_G$ to be determined for the green sub-pixel may be selected from a predetermined range of the first parameter for the green sub-pixel, and the second parameter $b_G$ to be determined for the green sub-pixel may be selected from a predetermined range of the second parameter for the green sub-pixel. The first parameter $a_B$ to be determined for the blue sub-pixel may be selected from a predetermined range of the first parameter for the blue sub-pixel, and the second parameter $b_B$ to be determined for the blue sub-pixel may be selected from a predetermined range of the second parameter for the blue sub-pixel.

At step S504, the relation $m=ax+b$ of the sub-pixel of the certain color to be determined is obtained based on the first parameter to be determined and the second parameter to be determined, so that the attenuation parameter of the sub-pixel of the certain color in the bending area is obtained.

In this step, the first parameter "a" to be determined and the second parameter "b" to be determined that are selected above are substituted into the relation $m=ax+b$ for the sub-pixel of the certain color so that the calculation relation of the attenuation parameter of the sub-pixel of the certain color is obtained. Then, the attenuation parameter m of the sub-pixel of the certain color under different x may be calculated based on the calculation relation of the attenuation parameter. It should be noted that, since the first parameter "a" and the second parameter "b" are both parameters to be determined, the corresponding calculation relation of the attenuation parameter and the attenuation parameter are also to be determined.

For example, for the red sub-pixel, the first parameter $a_R$ to be determined and the second parameter $b_R$ to be determined for the red sub-pixel are substituted into $m_R=a_Rx_R+b_R$ for the red sub-pixel so that the calculation relation for the attenuation parameter of the red sub-pixel may be obtained. Then, the attenuation parameter $m_R$ of the red sub-pixel under different $x_R$ may be calculated based on the calculation relation for the attenuation parameter.

For another example, for the green sub-pixel, the first parameter $a_G$ to be determined and the second parameter $b_G$ to be determined for the green sub-pixel are substituted into $m_G=a_Gx_G+b_G$ for the green sub-pixel so that the calculation relation for the attenuation parameter of the green sub-pixel may be obtained. Then, the attenuation parameter $m_G$ of the green sub-pixel under different $x_G$ may be calculated based on the calculation relation for the attenuation parameter.

For another example, for the blue sub-pixel, the first parameter $a_B$ to be determined and the second $b_B$ to be determined for the blue sub-pixel are substituted into $m_B=a_Bx_B+b_B$ for the blue sub-pixel so that the calculation relation for the attenuation parameter of the blue sub-pixel may be obtained. Then, the attenuation parameter $m_B$ of the blue sub-pixel under different $x_B$ may be calculated based on the calculation relation for the attenuation parameter.

At step S506, the light emission brightness of the sub-pixel of the certain color is adjusted based on the attenuation parameter of the sub-pixel of the certain color.

For example, the light emission brightness of the red sub-pixel is adjusted based on the attenuation parameter of the red sub-pixel. For another example, the light emission brightness of the green sub-pixel is adjusted based on the attenuation parameter of the green sub-pixel. For another example, the light emission brightness of the blue sub-pixel is adjusted based on the attenuation parameter of the blue sub-pixel.

At step S508, the display panel is caused to display an image after the light emission brightness of the sub-pixel of the certain color is adjusted.

For example, the display panel may be caused to display a pure white image e (i.e., a white balance image). In the case of the pure white image, it is possible to obtain the display effect in the bending area.

At step S510, color coordinates (e.g., average color coordinates) of the image displayed in the non-bending area of the display panel are compared with color coordinates (e.g., average color coordinates) of the image displayed in the bending area, and it is determined whether the first parameter to be determined is able to serve as the first parameter for the sub-pixel of the certain color of the display panel, and whether the second parameter to be determined is able to serve as the second parameter for the sub-pixel of the certain color of the display panel based on a comparison result.

In some embodiments, the display effect of the image displayed in the non-bending area of the display panel (color coordinates may be estimated) may be compared with that of the image displayed in the bending area (color coordinates may be estimated) in a manner of observation by human eyes, thereby performing the above-described determining step based on the comparison result. In other embodiments, the average color coordinates of the image displayed in the non-bending area of the display panel and the average color coordinates of the image displayed in the bending area may also be detected, thereby performing the above-described comparing and determining steps.

In some embodiments, the above-described step of performing the comparison may comprise: obtaining the color coordinates (e.g., average color coordinates) of the image displayed in the non-bending area and the color coordinates (e.g., average color coordinates) of the image displayed in the bending area at a viewing angle perpendicular to the non-bending area. For example, for display devices such as display screens, mobile phones, and monitors, the viewers usually view images or videos at a viewing angle perpendicular to the non-bending area (at this time, the line of sight of the viewer that reaches the bending area is tilted). Therefore, the color coordinates (e.g., the average color coordinates) of the image displayed in the non-bending area and the color coordinates (e.g., the average color coordinates) of the image displayed in the bending area may be obtained at a viewing angle perpendicular to the non-bending area.

In some embodiments, the above-described step of performing comparison may further comprise: calculating a difference between color coordinates (e.g., the average color coordinates) of the image displayed in the non-bending area and the color coordinates (e.g., the average color coordinates) of the image displayed in the bending area value. The color coordinates comprise abscissa and ordinate. Therefore, when the difference is calculated, the difference between the abscissas of the color coordinates (e.g., the average color coordinates) of the image displayed in the non-bending area and the abscissas of the color coordinates (e.g., the average color coordinates) of the image displayed in the bending area, and the difference between the ordinates of the color coordinates (e.g., the average color coordinates) of the image displayed in the non-bending area and the ordinates of the color coordinates (e.g., the average color coordinates) of the image displayed in the bending area may be calculated respectively.

In some embodiments, the step of performing determination based on the comparison result may comprise: determining whether the difference is within a predetermined error range. It is determined that the first parameter to be determined serves as the first parameter for the sub-pixel of the certain color of the display panel, and the second parameter to be determined serves as the second parameter for the sub-pixel of the certain color of the display panel, in a case where the difference is within the predetermined error range. The first parameter to be determined and the second parameter to be determined are reselected in a case where the difference is not within the predetermined error range.

For example, the predetermined error range may be [0.01, 0.03]. That is, the predetermined error range of the abscissas of the color coordinates may be [0.01, 0.03], and the predetermined error range of the ordinates of the color coordinates may also be [0.01, 0.03]. It may be determined whether the difference between the abscissas of the color coordinates (e.g., the average color coordinates) is within the predetermined error range of the abscissas, and whether the difference between the ordinates of the color coordinates (e.g., the average color coordinates) is within the predetermined error range of the ordinates. When the difference is within the predetermined error range (i.e., the difference between the abscissas of the color coordinates is within the predetermined error range of the abscissas, and the difference between the ordinates of the color coordinates is within the predetermined error range of the ordinates), it is indicated that the selected first parameter and second parameter to be determined are the first parameter and the second parameter for the sub-pixel of the certain color in the bending area of the display panel. The corresponding calculation relation of the attenuation parameter may be obtained by using these two parameters, so as to calculate the attenuation parameter of the sub-pixel of the certain color. When the difference is not within the predetermined error range, it is necessary to reselect the first parameter to be determined from the predetermined range of the first parameter and reselect the second parameter to be determined from the predetermined range of the second parameter. Then, after the steps S504 to S510, it is redetermined whether the reselected first parameter and the reselected second parameter to be determined are the required first parameter and second parameter.

In some embodiments, the selection may be performed in a stepwise manner when the first parameter and the second parameter are selected. For example, the step length may be 0.1 or 0.2 when the first parameter "a" is selected. That is, within the predetermined range of $0<a\leq5$ of the first parameter "a", the parameter to be determined is selected according to the step length of 0.1 or 0.2 each time. For example, the step length may be 1 when the second parameter "b" is selected. That is, within the predetermined range of $0\leq b\leq100$ of the second parameter "b", the second parameter to be determined is selected according to the step length of 1 each time.

So far, a method of obtaining the first parameter and the second parameter according to some embodiments of the present disclosure is provided. In this method, the first parameter and the second parameter are selected within a predetermined range, and the selected first parameter and second parameter are tested, thereby determining the first parameter and the second parameter.

After the first parameter and the second parameter are determined, the calculation relation of the attenuation parameter of the sub-pixel of the certain color is obtained. In this way, it is possible to cause sub-pixels of different colors in the bending area to have substantially the same attenuation condition, thereby implementing adjusting the light emission brightness of sub-pixels of different colors at different positions, reducing the problem of color cast in the bending area, and improving the display effect.

In the above-described method of some embodiments, a first parameter and a second parameter to be determined for sub-pixels of three colors (red, green, and blue) may be selected at the same time, so that the light emission brightness of sub-pixels of different colors may be adjusted. When an image is displayed on the display panel, it is possible to cause the image to be a pure white image (i.e., a white balance image), and then compare the color coordinates of the pure white picture in the bending area and the non-bending area, thereby determining whether the first parameter and second parameter to be determined are the required first parameter and second parameter. In this way, the first parameter and the second parameter for the calculation relations of the attenuation parameters of sub-pixels of the three colors may be obtained together, so that it is more convenient to implement.

In the above-described method of other embodiments, the first parameter and the second parameter for the calculation relations of sub-pixels of different colors may be obtained respectively. For example, the first parameter and second parameter to be determined for the red sub-pixel may be obtained, so that the light emission brightness of the red sub-pixel is adjusted. When the display panel displays an image, it is possible to cause the image to be a pure red image, and then compare the color coordinates of the pure red image in the bending area and the non-bending area, thereby determining whether the first parameter and the second parameter to be determined are the required first and second parameters for the red sub-pixel. The method for determining the first parameter and the second parameter for the green or blue sub-pixel is similar, and thus will not be described in detail here.

In some embodiments of the present disclosure, a display panel is also provided. For example, the control method described above may be used to make the display panel display. The display panel comprises the bending area.

Figure 6:
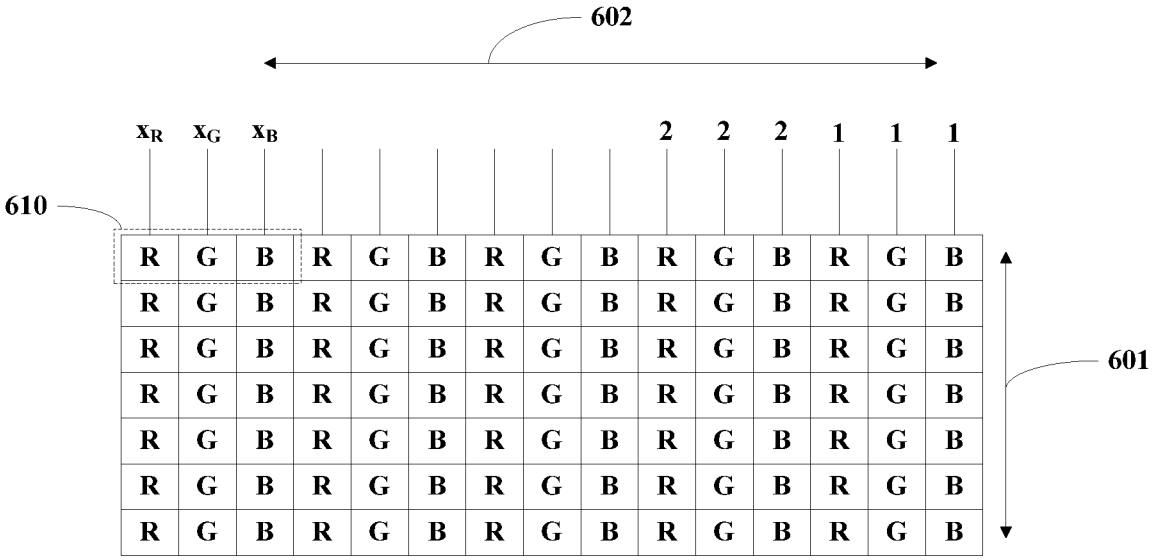
FIG. 6 is a schematic view showing an arrangement of sub-pixels in a bending area of a display panel according to an embodiment of the present disclosure.

FIG. 6 is a schematic view showing an arrangement of sub-pixels in a bending area of a display panel according to an embodiment of the present disclosure. As shown in FIG. 6, the bending area comprises a plurality of pixels 610. Each pixel 610 comprises a red sub-pixel R, a green sub-pixel G, and a blue sub-pixel B. In FIG. 6, the red sub-pixels R (or the green sub-pixels G or the blue sub-pixels B) arranged longitudinally are sub-pixels in the same sub-pixel column, that is, a column of sub-pixels parallel to an extending direction 601 of the first edge. The sub-pixels (comprising the red sub-pixel R, the green sub-pixel G, and the blue sub-pixel B) arranged transversely are sub-pixels in the same sub-pixel row, that is, a row of sub-pixels in a direction 602 perpendicular to the extending direction of the first edge. In each pixel 610, the red sub-pixel R, the green sub-pixel G, and the blue sub-pixel B are in the same row. In each pixel 610, the green sub-pixel G is between the red sub-pixel R and the blue sub-pixel B. In the bending area, sub-pixels in a same sub-pixel column have a same light emission color. For example, the sub-pixels in the same sub-pixel column are all red sub-pixels R, or all green sub-pixels G, or all blue sub-pixels B. The sub-pixels in two adjacent sub-pixel columns have different light emission colors.

For example, FIG. 6 shows a first pixel column, a second pixel column, . . . an x-th pixel column. For example, the first pixel column is a pixel column at the first edge. The first pixel column comprises a first red sub-pixel column, a first green sub-pixel column, and a first blue sub-pixel column. Similarly, the x-th pixel column comprises an x-th red sub-pixel column, an x-th green sub-pixel column, and an x-th blue sub-pixel column. In such case, x in the calculation relation (1) of the attenuation parameter is the number of sub-pixel columns between the sub-pixel column where a sub-pixel of a certain color is located of which the attenuation parameter needs to be calculated and the first edge, and having the certain color. Therefore, the x value may be conveniently obtained in the case of the arrangement of the sub-pixels shown in FIG. 6.

In addition, since the sub-pixels in the same sub-pixel column are sub-pixels having the same light emission color, the sub-pixels in the same sub-pixel column may have a same attenuation parameter. Therefore, as long as the attenuation parameters of one sub-pixel in a certain sub-pixel column are calculated, the attenuation parameters of all sub-pixels in the sub-pixel column are obtained. In this way, the attenuation parameters of the sub-pixels in different sub-pixel columns may be conveniently calculated, thereby facilitating adjusting the light emission brightness of the sub-pixels.

Figure 7:
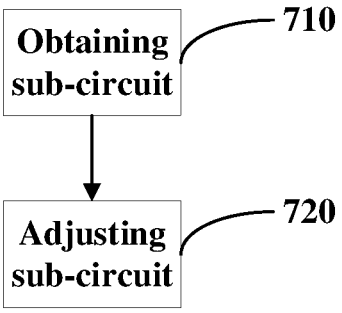
FIG. 7 is a schematic structural view showing a control device for a display panel according to an embodiment of the present disclosure.

FIG. 7 is a schematic structural view showing a control device for a display panel according to an embodiment of the present disclosure. The display panel comprises a bending area comprising a plurality of sub-pixels. As shown in FIG. 7, the control device comprises an obtaining sub-circuit 710 and an adjusting sub-circuit 720.

The obtaining sub-circuit 710 is configured to obtain an attenuation parameter of a sub-pixel of at least one color in the bending area. The attenuation parameter is a pre-attenuation amount of brightness attenuation of the sub-pixel.

The adjusting sub-circuit 720 is configured to obtain a pre-register value of the sub-pixel of the at least one color corresponding to gray-scale data of a pixel to which the sub-pixel of the at least one color belongs, and adjust light emission brightness of the sub-pixel of the at least one color based on the pre-register value and the attenuation parameter of the sub-pixel of the at least one color.

So far, a control device for a display panel according to some embodiments of the present disclosure is provided. In this embodiment, the control device adjusts the light emission brightness of sub-pixels of different colors based on the attenuation parameter, so that sub-pixels of different colors in the bending area have substantially the same attenuation condition, which may reduce the problem of color cast in the bending area (e.g., the reddish or pinkish problem of the bending area), and improve the display effect of the display panel.

In some embodiments, the obtaining sub-circuit 710 is configured to determine a pixel column at a maximum curvature in the bending area. Each pixel comprises a red sub-pixel, a green sub-pixel, and a blue sub-pixel. The obtaining sub-circuit 710 is further configured to obtain the attenuation parameter of the sub-pixel of the at least one color of each pixel in part of pixels in the bending area. The part of pixels comprise pixels from a pixel column at a first edge of the bending area to the pixel column at the maximum curvature. The first edge is at a boundary between the bending area and the non-bending area.

In some embodiments, the adjusting sub-circuit 720 is configured to determine an actual register value of the sub-pixel of the at least one color based on the pre-register value of the sub-pixel of the at least one color and the attenuation parameter of the sub-pixel of the at least one color. The adjusting sub-circuit 720 is further configured to control the light emission brightness of the sub-pixel of the at least one color based on the actual register value of the sub-pixel of the at least one color.

In some embodiments, the obtaining sub-circuit 710 is further configured to obtain a first parameter and a second parameter for the sub-pixel of the at least one color of the display panel.

In some embodiments, the obtaining sub-circuit 710 is configured to select the first parameter "a" to be determined for a sub-pixel of a certain color from a predetermined range of the first parameter for the sub-pixel of the at least one color, and select the second parameter "b" to be determined for the sub-pixel of the certain color from a predetermined range of the second parameter for the sub-pixel of the at least one color. The obtaining sub-circuit 710 is further configured to obtain the relation $m=ax+b$ of the sub-pixel of the certain color to be determined based on the first parameter to be determined and the second parameter to be determined, thereby obtaining the attenuation parameter of the sub-pixel of the certain color in the bending area.

In some embodiments, the adjusting sub-circuit 720 is configured to adjust the light emission brightness of the sub-pixel of the certain color based on the attenuation parameter of the sub-pixel of the certain color. The adjusting sub-circuit 720 is further configured to cause the display panel to display an image after the light emission brightness of the sub-pixel of the certain color is adjusted.

In some embodiments, the obtaining sub-circuit 710 is further configured to compare color coordinates of the image displayed in the non-bending area of the display panel with color coordinates of the image displayed in the bending area, and determine whether the first parameter to be determined is able to serve as the first parameter for the sub-pixel of the certain color of the display panel, and whether the second parameter to be determined is able to serve as the second parameter for the sub-pixel of the certain color of the display panel based on a comparison result.

For example, the obtaining sub-circuit 710 is configured to obtain the color coordinates of the image displayed in the non-bending area and the color coordinates of the image displayed in the bending area at a viewing angle perpendicular to the non-bending area; and calculate a difference between the color coordinates of the image displayed in the non-bending area and the color coordinates of the image displayed in the bending area.

For example, the obtaining sub-circuit 710 is configured to determine whether the difference is within a predetermined error range. The obtaining sub-circuit 710 is configured to determine that the first parameter to be determined serves as the first parameter for the sub-pixel of the certain color of the display panel, and the second parameter to be determined serves as the second parameter for the sub-pixel of the certain color of the display panel, in a case where the difference is within the predetermined error range. The obtaining sub-circuit 710 is further configured to reselect the first parameter to be determined and the second parameter to be determined in a case where the difference is not within the predetermined error range.

Figure 8:
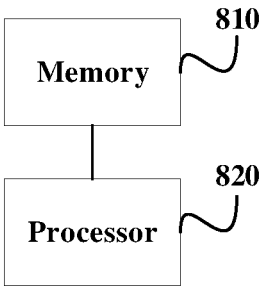
FIG. 8 is a schematic structural view showing a control device for a display panel according to another embodiment of the present disclosure.

FIG. 8 is a schematic structural view showing a control device for a display panel according to another embodiment of the present disclosure. The control device comprises a memory 810 and a processor 820. Wherein:

The memory 810 may be a magnetic disk, a flash memory, or any other non-volatile storage medium. The memory is configured to store instructions in the embodiments corresponding to at least one of FIG. 3, 4 or 5.

The processor 820 which is coupled to the memory 810, may be implemented as one or more integrated circuits, such as a microprocessor or a microcontroller. The processor 820 is configured to execute instructions stored in the memory so as to adjust the light emission brightness of a sub-pixel of a certain color based on the attenuation parameter, so that sub-pixels of different colors in the bending area have substantially the same attenuation condition, and the problem of color cast may be reduced (e.g., the reddish or pinkish problem in the bending area may be reduced), thereby improving the display effect of the display panel.

Figure 9:
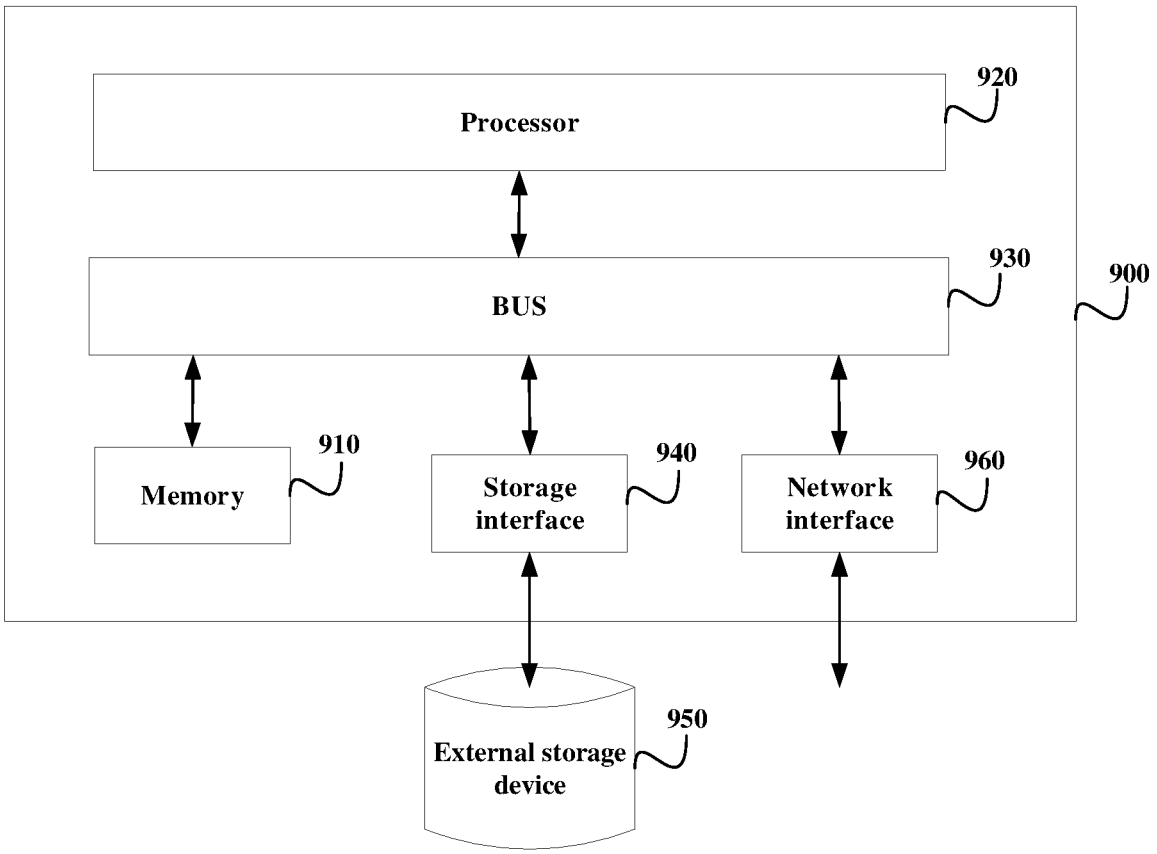
FIG. 9 is a schematic structural view showing a control device for a display panel according to another embodiment of the present disclosure.

In some embodiments, also as shown in FIG. 9, the control device 900 comprises a memory 910 and a processor 920. The processor 920 is coupled to the memory 910 through a BUS 930. The control device 900 may also be connected to the external storage device 950 through the storage interface 940 to call external data, and may also be connected to the network or another computer system (not shown) through the network interface 960, which will not be described in detail here.

In this embodiment, the data instructions are stored in the memory, and processed by the processor, so as to adjust the light emission brightness of the sub-pixel of the certain color based on the attenuation parameter, so that sub-pixels of different colors in the bending area have substantially the same attenuation condition, and the problem of color cast may be reduced (e.g., the reddish or pinkish problem in the bending area may be reduced), thereby improving the display effect of the display panel.

In some embodiments of the present disclosure, a display device is also provided. The display device may comprise the control device described above (e.g., the control device shown in FIG. 7, 8 or 9).

In some embodiments of the present disclosure, a non-transitory computer-readable storage medium is also provided. The computer-readable storage medium has computer program instructions stored thereon, and the instructions when executed by the processor implement the steps of the method in the embodiments corresponding to at least one of FIG. 3, 4 or 5. Those skilled in the art will appreciate that the embodiments of the present disclosure may be provided as a method, device, or computer program product. Accordingly, the present disclosure may take the form of an entirely hardware embodiment, an entirely software embodiment, or a combination of software and hardware aspects. Moreover, the present disclosure may take the form of a computer program product embodied in one or more computer-usable non-transitory storage media (comprising but not limited to disk memory, CD-ROM, optical memory, and the like) containing computer usable program codes therein.

The present disclosure is described in conjunction with the flow charts and/or block views of methods, devices (systems), and computer program products according to the embodiments of the present disclosure. It will be understood that each step and/or block of the flowcharts and/or block views as well as a combination of steps and/or blocks of the flow charts and/or block views may be implemented by a computer program instruction. These computer program instructions may be provided to a processor of a general purpose computer, special purpose computer, an embedded processing machine, or other programmable data processing devices to produce a machine, such that the instructions executed by a processor of a computer or other programmable data processing devices produce a device for realizing a function designated in one or more steps of a flow chart and/or one or more blocks in a block view.

These computer program instructions may also be stored in a computer readable memory that may guide a computer or other programmable data processing device to operate in a particular manner, such that the instructions stored in the computer readable memory produce a manufacture comprising an instruction device. The instruction device realizes a function designated in one or more steps in a flow chart or one or more blocks in a block view.

These computer program instructions may also be loaded onto a computer or other programmable data processing devices, such that a series of operational steps are performed on a computer or other programmable device to produce a computer-implemented processing, such that the instructions executed on a computer or other programmable devices provide steps for realizing a function designated in one or more steps of the flow chart and/or one or more blocks in the block view.

Hereto, various embodiments of the present disclosure have been described in detail. Some details well known in the art are not described to avoid obscuring the concept of the present disclosure. According to the above description, those skilled in the art would fully know how to implement the technical solutions disclosed herein.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above embodiments and equivalently substitution of part of the technical features may be made without departing from the scope and spirit of the present disclosure. The scope of the present disclosure is defined by the appended claims.

What is claimed is:

1. A control method for a display panel, the display panel comprising a bending area, the bending area comprising a plurality of sub-pixels, and the control method comprising:

obtaining an attenuation parameter of a sub-pixel of at least one color in the bending area, wherein the attenuation parameter is a pre-attenuation amount of brightness attenuation of the sub-pixel;

obtaining a pre-register value of the sub-pixel of the at least one color corresponding to grayscale data of a pixel to which the sub-pixel of the at least one color belongs; and adjusting light emission brightness of the sub-pixel of the at least one color based on the pre-register value and the attenuation parameter of the sub-pixel of the at least one color;

wherein the obtaining of the attenuation parameter of the sub-pixel of the at least one color in the bending area comprises: determining a pixel column at a maximum curvature in the bending area, each pixel in the bending area comprising a red sub-pixel, a green sub-pixel, and a blue sub-pixel; and obtaining the attenuation parameter of the sub-pixel of the at least one color of the each pixel in part of pixels in the bending area, wherein the part of pixels comprise pixels from a pixel column at a first edge of the bending area to the pixel column at the maximum curvature in the bending area, the display panel further comprises a non-bending area, and the first edge is at a boundary between the bending area and the non-bending area;

wherein the attenuation parameter m of the sub-pixel of the at least one color is obtained according to the following relation:

$$m=ax+b,$$

where "x" represents a position of a sub-pixel of a certain color, of which the attenuation parameter needs to be calculated, wherein the position "x" is a number of sub-pixels of the certain color between the sub-pixel of the certain color and the first edge of the bending area, and in a sub-pixel row where the sub-pixel of the certain color is located, in a case where the sub-pixel of the certain color is between the first edge and the pixel column at the maximum curvature, "a" is a first parameter for calculating the attenuation parameter of the sub-pixel of the certain color, and "b" is a second parameter for calculating the attenuation parameter of the sub-pixel of the certain color;

the control method further comprising:

obtaining the first parameter and the second parameter for the sub-pixel of the at least one color of the display panel before the attenuation parameter of the sub-pixel of the at least one color in the bending area is obtained.

2. The control method according to claim 1, wherein the adjusting of the light emission brightness of the sub-pixel of the at least one color based on the pre-register value and the attenuation parameter of the sub-pixel of the at least one color comprises:

determining an actual register value of the sub-pixel of the at least one color based on the pre-register value of the sub-pixel of the at least one color and the attenuation parameter of the sub-pixel of the at least one color; and controlling the light emission brightness of the sub-pixel of the at least one color based on the actual register value of the sub-pixel of the at least one color.

3. The control method according to claim 2, wherein the actual register value of the sub-pixel is a difference between the pre-register value of the sub-pixel and the attenuation parameter of the sub-pixel.

4. The control method according to claim 1, wherein the obtaining of the first parameter and the second parameter for the sub-pixel of the at least one color of the display panel comprises:

selecting the first parameter "a" to be determined for the sub-pixel of the certain color from a predetermined range of the first parameter for the sub-pixel of the at least one color, and selecting the second parameter "b" to be determined for the sub-pixel of the certain color from a predetermined range of the second parameter for the sub-pixel of the at least one color;

obtaining the relation m=ax+b of the sub-pixel of the certain color to be determined based on the first parameter to be determined and the second parameter to be determined, thereby obtaining the attenuation parameter of the sub-pixel of the certain color in the bending area;

adjusting the light emission brightness of the sub-pixel of the certain color based on the attenuation parameter of the sub-pixel of the certain color;

causing the display panel to display an image after the light emission brightness of the sub-pixel of the certain color is adjusted; and comparing color coordinates of the image displayed in the non-bending area of the display panel with color coordinates of the image displayed in the bending area, and determining whether the first parameter to be determined is able to serve as the first parameter for the sub-pixel of the certain color of the display panel, and whether the second parameter to be determined is able to serve as the second parameter for the sub-pixel of the certain color of the display panel based on a comparison result.

5. The control method according to claim 4, wherein:

the comparing comprises: obtaining the color coordinates of the image displayed in the non-bending area and the color coordinates of the image displayed in the bending area at a viewing angle perpendicular to the non-bending area; and calculating a difference between the color coordinates of the image displayed in the non-bending area and the color coordinates of the image displayed in the bending area;

the determining based on the comparison result comprises:

determining whether the difference is within a predetermined error range;

determining the first parameter to be determined as the first parameter for the sub-pixel of the certain color of the display panel, and the second parameter to be determined as the second parameter for the sub-pixel of the certain color of the display panel, in a case where the difference is within the predetermined error range; and reselecting the first parameter to be determined and the second parameter to be determined in a case where the difference is not within the predetermined error range.

6. The control method according to claim 4, wherein:

the predetermined range of the first parameter "a" is $0<a\leq 5$; and the predetermined range of the second parameter "b" is $0\leq b\leq 100$.

7. The control method according to claim 1, wherein:

the attenuation parameter of the sub-pixel of the at least one color comprises an attenuation parameter of the red sub-pixel; and the attenuation parameter $m_R$ of the red sub-pixel is obtained according to the following relation:

$$m_R=a_R x_R+b_R,$$

where $x_R$ represents a position of the red sub-pixel, of which the attenuation parameter needs to be calculated, wherein the position $x_R$ is a number of red sub-pixels between the red sub-pixel and the first edge of the bending area, and in a sub-pixel row where the red sub-pixel is located, in a case where the red sub-pixel is between the first edge and the pixel column at the maximum curvature, $a_R$ is a first parameter for calculating the attenuation parameter of the red sub-pixel, and $b_R$ is a second parameter for calculating the attenuation parameter of the red sub-pixel.

8. The control method according to claim 1, wherein:

the attenuation parameter of the sub-pixel of the at least one color comprises an attenuation parameter of the green sub-pixel; and the attenuation parameter $m_G$ of the green sub-pixel is obtained according to the following relation:

$$m_G=a_G x_G+b_G,$$

where $x_G$ represents a position of the green sub-pixel, of which the attenuation parameter needs to be calculated, wherein the position $x_G$ is a number of green sub-pixels between the green sub-pixel and the first edge of the bending area, and in a sub-pixel row where the green sub-pixel is located, in a case where the green sub-pixel is between the first edge and the pixel column at the maximum curvature, $a_G$ is a first parameter for calculating the attenuation parameter of the green sub-pixel, and $b_G$ is a second parameter for calculating the attenuation parameter of the green sub-pixel.

9. The control method according to claim 1, wherein:

the attenuation parameter of the sub-pixel of the at least one color comprises an attenuation parameter of the blue sub-pixel; and the attenuation parameter $m_B$ of the blue sub-pixel is obtained according to the following relation:

$$m_B=a_B x_B+b_B,$$

where $x_B$ represents a position of the blue sub-pixel of which the attenuation parameter needs to be calculated, wherein the position $x_B$ is a number of blue sub-pixels between the blue sub-pixel and the first edge of the bending area, and in a sub-pixel row where the blue sub-pixel is located, in a case where the blue sub-pixel is between the first edge and the pixel column at the maximum curvature, $a_B$ is a first parameter for calculating the attenuation parameter of the blue sub-pixel, and $b_B$ is a second parameter for calculating the attenuation parameter of the blue sub-pixel.

10. The control method according to claim 1, wherein:

in the bending area, sub-pixels in a same sub-pixel column have a same light emission color, and sub-pixels in two adjacent sub-pixel columns have different light emission colors; and the green sub-pixel is between the red sub-pixel and the blue sub-pixel in the each pixel.

11. A control device for a display panel, comprising:

a memory; and a processor coupled to the memory, wherein the processor is configured to, based on instructions stored in the memory, obtain an attenuation parameter of a sub-pixel of at least one color of a plurality of sub-pixels in a bending area of the display panel, wherein the attenuation parameter is a pre-attenuation amount of brightness attenuation of the sub-pixel;

obtain a pre-register value of the sub-pixel of the at least one color corresponding to grayscale data of a pixel to which the sub-pixel of the at least one color belongs; and adjust light emission brightness of the sub-pixel of the at least one color based on the pre-register value and the attenuation parameter of the sub-pixel of the at least one color;

wherein the obtaining of the attenuation parameter of the sub-pixel of the at least one color in the bending area comprises: determining a pixel column at a maximum curvature in the bending area, each pixel in the bending area comprising a red sub-pixel, a green sub-pixel, and a blue sub-pixel; and obtaining the attenuation parameter of the sub-pixel of the at least one color of the each pixel in part of pixels in the bending area, wherein the par of pixels comprise pixels from a pixel column at a first edge of the bending area to the pixel column at the maximum curvature in the bending area, the display panel further comprises a non-bending area, and the first edge is at a boundary between the bending area and the non-bending area;

wherein the attenuation parameter m of the sub-pixel of the at least one color is obtained according to the following relation:

$$m=ax+b,$$

where "x" represents a position of a sub-pixel of a certain color, of which the attenuation parameter needs to be calculated, wherein the position "x" is a number of sub-pixels of the certain color between the sub-pixel of the certain color and the first edge of the bending area, and in a sub-pixel row where the sub-pixel of the certain color is located, in a case where the sub-pixel of the certain color is between the first edge and the pixel column at the maximum curvature, "a" is a first parameter for calculating the attenuation parameter of the sub-pixel of the certain color, and "b" is a second parameter for calculating the attenuation parameter of the sub-pixel of the certain color;

wherein the processor is further configured to obtain the first parameter and the second parameter for the sub-pixel of the at least one color of the display panel before the attenuation parameter of the sub-pixel of the at least one color in the bending area is obtained.

12. A display device, comprising the control device according to claim 11.

13. A non-transitory computer-readable storage medium having computer program instructions stored thereon, wherein when the instructions are executed by a processor, the processor is configured to:

obtain an attenuation parameter of a sub-pixel of at least one color of a plurality of sub-pixels in a bending area of the display panel, wherein the attenuation parameter is a pre-attenuation amount of brightness attenuation of the sub-pixel;

obtain a pre-register value of the sub-pixel of the at least one color corresponding to grayscale data of a pixel to which the sub-pixel of the at least one color belongs; and adjust light emission brightness of the sub-pixel of the at least one color based on the pre-register value and the attenuation parameter of the sub-pixel of the at least one color;

wherein the obtaining of the attenuation parameter of the sub-pixel of the at least one color in the bending area comprises: determining a pixel column at a maximum curvature in the bending area, each pixel in the bending area comprising a red sub-pixel, a green sub-pixel, and a blue sub-pixel; and obtaining the attenuation parameter of the sub-pixel of the at least one color of the each pixel in part of pixels in the bending area, wherein the par of pixels comprise pixels from a pixel column at a first edge of the bending area to the pixel column at the maximum curvature in the bending area, the display panel further comprises a non-bending area, and the first edge is at a boundary between the bending area and the non-bending area;

wherein the attenuation parameter m of the sub-pixel of the at least one color is obtained according to the following relation:

$$m=ax+b,$$

where "x" represents a position of a sub-pixel of a certain color, of which the attenuation parameter needs to be calculated, wherein the position "x" is a number of sub-pixels of the certain color between the sub-pixel of the certain color and the first edge of the bending area, and in a sub-pixel row where the sub-pixel of the certain color is located, in a case where the sub-pixel of the certain color is between the first edge and the pixel column at the maximum curvature, "a" is a first parameter for calculating the attenuation parameter of the sub-pixel of the certain color, and "b" is a second parameter for calculating the attenuation parameter of the sub-pixel of the certain color;

wherein the processor is further configured to obtain the first parameter and the second parameter for the sub-pixel of the at least one color of the display panel before the attenuation parameter of the sub-pixel of the at least one color in the bending area is obtained.

* * * * *